US011817024B2

(12) United States Patent
Watanabe

(10) Patent No.: US 11,817,024 B2
(45) Date of Patent: Nov. 14, 2023

(54) DISPLAY DRIVER AND DISPLAY DEVICE

(71) Applicant: LAPIS Technology Co., Ltd., Yokohama (JP)

(72) Inventor: Yukinobu Watanabe, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 0 days.

(21) Appl. No.: 17/976,443

(22) Filed: Oct. 28, 2022

(65) Prior Publication Data

US 2023/0134769 A1 May 4, 2023

(30) Foreign Application Priority Data

Oct. 29, 2021 (JP) ..... 2021-177403

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/0291* (2013.01); *G09G 2310/08* (2013.01); *G09G 2360/10* (2013.01)

(58) Field of Classification Search
CPC .. G09G 3/006; G09G 3/20; G09G 2310/0291; G09G 2310/08; G09G 2360/10
See application file for complete search history.

(56) References Cited

U.S. PATENT DOCUMENTS

2016/0322013 A1* 11/2016 Fukute ..... G09G 3/3648
2022/0415230 A1* 12/2022 Kwon ..... G09G 3/20

FOREIGN PATENT DOCUMENTS

JP 2016206578 A 12/2016

* cited by examiner

*Primary Examiner* — Gerald Johnson
(74) *Attorney, Agent, or Firm* — Rabin & Berdo, P.C.

(57) ABSTRACT

In the present invention, output circuits are connected to respective external terminals. Each output circuit includes an operational amplifier that outputs a current to one external terminal until a voltage of the external terminal becomes equal to a gradation voltage received by an input terminal thereof, and a disconnection detection circuit that detects whether a wiring connected to the one external terminal is disconnected or not. The disconnection detection circuit supplies a test voltage instead of the gradation voltage to the input terminal of the operational amplifier in a non-display period and measures a time period taken from then until the voltage of the one external terminal exceeds a reference voltage as a rise time. The disconnection detection circuit detects whether the wiring connected to the one external terminal is disconnected or not based on the rise time measured in one frame and the rise time measured in another frame.

8 Claims, 5 Drawing Sheets

DISPLAY DRIVER AND DISPLAY DEVICE

CROSS-REFERENCE TO RELATED APPLICATION

This application is based upon and claims the benefit of priority from the prior Japanese Patent Application No. 2021-177403 filed on Oct. 29, 2021, the entire contents of which are incorporated herein by reference.

BACKGROUND

1. Technical Field

The present invention relates to a display driver that drives a display panel corresponding to a video signal, and a display device.

2. Description of the Related Art

Recently, a vehicle in which a display panel, such as a liquid crystal display panel and an organic Electro Luminescence (EL) display panel, is used for displaying a scene around the vehicle, a vehicle state, running information, and the like has appeared. When the display panel has a breakdown and an incorrect display is made during running of the vehicle, driving is possibly interfered.

Therefore, there has been proposed a display device configured to always detect whether an abnormal display or a panel breakdown has occurred or not in a display driver side for the display panel during an operation and notify a controller side of the detection result to deal with the breakdown of the display panel (for example, see JP-A-2016-206578).

The display device disclosed in JP-A-2016-206578 includes a display panel in which a plurality of gate lines and source lines are intersected and arranged side by side on a glass substrate, and a loop-shaped disconnection-detecting line is formed along an outer edge of the glass substrate. Further, the display driver includes a disconnection-detecting circuit configured to detect whether the disconnection-detecting line is disconnected or not by applying a detecting voltage to the disconnection-detecting line and detect a disconnection. That is, in the display device, when a damage such as a crack occurs at an outline or the glass substrate of the display panel, the disconnection-detecting line is disconnected due to the damage. Therefore, when the disconnection is detected, it is determined that a breakdown has occurred at the display panel.

SUMMARY OF THE INVENTION

However, while the display device disclosed in JP-A-2016-206578 can detect the damage of the outline or the glass substrate of the display panel as the breakdown, a disconnection of a wiring connecting between the display driver and the display panel cannot be detected.

The present invention has an object to provide a display driver and a display device allowing detecting a disconnection of a wiring connecting between a display panel and the display driver.

A display driver according to the present invention is a display driver that includes a plurality of external terminals and a plurality of output circuits disposed corresponding to the respective plurality of external terminals. Each of the plurality of output circuits is connected to one corresponding external terminal among the plurality of external terminals.

The plurality of output circuits supply a plurality of output voltages to a plurality of source lines of a display panel via a plurality of wirings connected to the plurality of external terminals by outputting the plurality of output voltages from the plurality of external terminals. The plurality of output voltages are obtained by amplifying a plurality of gradation voltages based on a video signal. Each of the plurality of output circuits includes: an operational amplifier that receives the gradation voltage by an input terminal thereof, and outputs a current to the one external terminal until a voltage of the external terminal becomes equal to the voltage received by the input terminal; and a disconnection detection circuit that detects whether the wiring connected to the one external terminal is disconnected or not. The disconnection detection circuit includes: a test voltage supply unit that supplies a test voltage instead of the gradation voltage to the input terminal of the operational amplifier in a non-display period of each frame of the video signal; a measurement unit that measures a time period taken from the supply of the test voltage to the input terminal of the operational amplifier until the voltage of the one external terminal exceeds a reference voltage as a rise time; and a disconnection determination unit that outputs a disconnection detection signal indicating whether the wiring connected to the one external terminal is disconnected or not based on the rise time measured in one frame and the rise time measured in another frame of the respective frames.

A display device according to the present invention is a display device that includes a display driver, a display panel, and a plurality of wirings. The display driver includes a plurality of external terminals and a plurality of output circuits disposed corresponding to the respective plurality of external terminals. Each of the plurality of output circuits is connected to one corresponding external terminal among the plurality of external terminals. The plurality of output circuits output a plurality of output voltages obtained by amplifying a plurality of gradation voltages based on a video signal from the plurality of external terminals. The display panel includes a plurality of source lines. The plurality of wirings connect between the plurality of external terminals and the plurality of source lines. Each of the plurality of output circuits includes: an operational amplifier that receives the gradation voltage by an input terminal thereof, and outputs a current to the one external terminal until a voltage of the external terminal becomes equal to the voltage received by the input terminal; and a disconnection detection circuit that detects whether the wiring connected to the one external terminal is disconnected or not. The disconnection detection circuit includes: a test voltage supply unit that supplies a test voltage instead of the gradation voltage to the input terminal of the operational amplifier in a non-display period of each frame of the video signal; a measurement unit that measures a time period taken from the supply of the test voltage to the input terminal of the operational amplifier until the voltage of the one external terminal exceeds a reference voltage as a rise time; and a disconnection determination unit that determines a disconnection of the wiring connected to the one external terminal and outputs a disconnection detection signal indicating the disconnection when the rise time measured in one frame does not match the rise time measured in another frame of the respective frames.

According to the present invention, during the normal display operation of the display device, whether the disconnection has occurred or not can be individually detected for the plurality of wirings connecting between the display driver and the respective plurality of source lines of the display panel.

DETAILED DESCRIPTION

The following describes embodiments of the present invention in detail with reference to the drawings.

Figure 1:
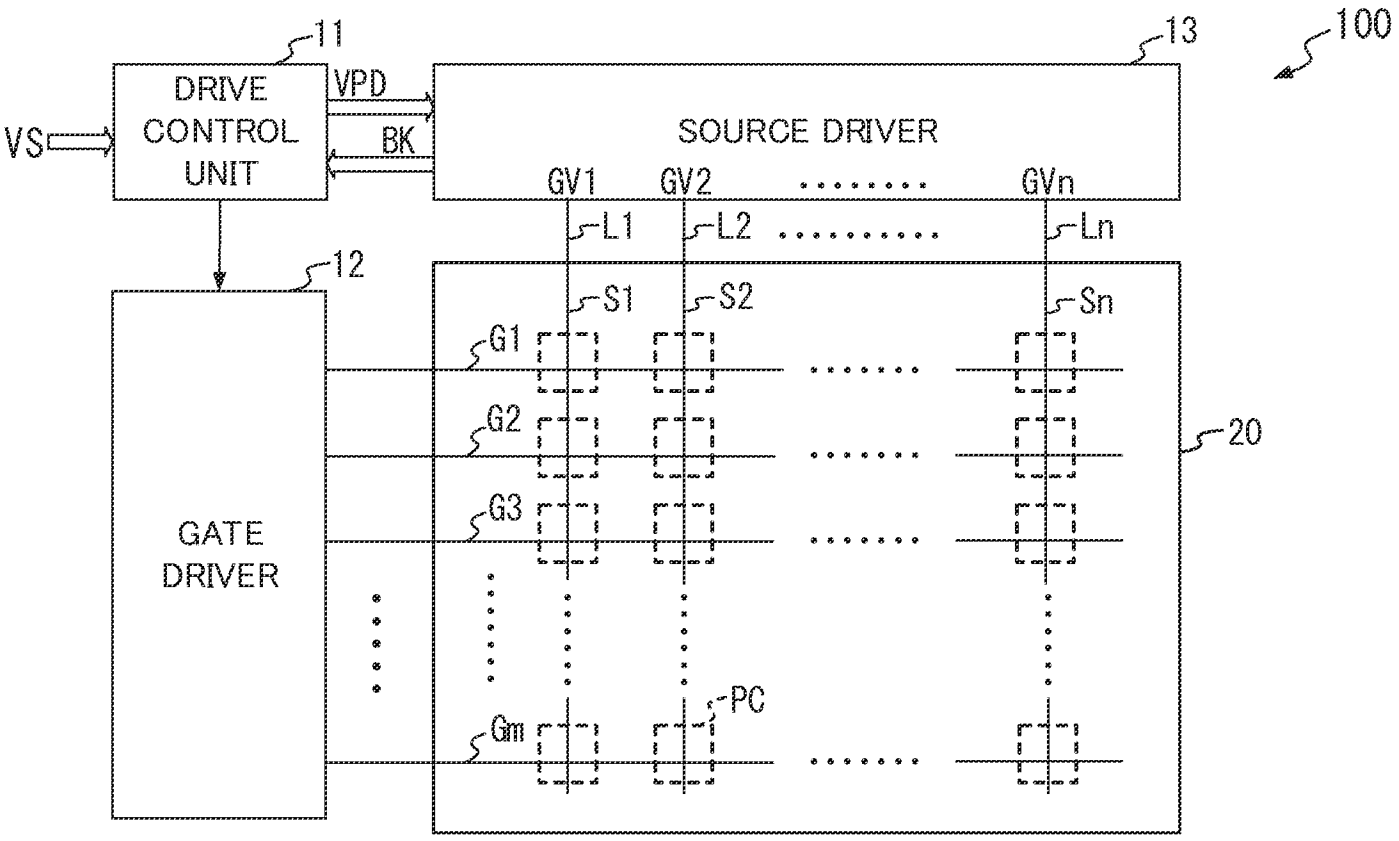
FIG. 1 is a block diagram illustrating a configuration of a display device 100 as a display device according to the present invention.

FIG. 1 is a block diagram illustrating a configuration of a display device 100 as a display device according to the present invention.

The display device 100 includes a drive control unit 11, a gate driver 12, a source driver 13, and a capacitive display panel 20.

In the display panel 20, gate lines G1 to Gm (m is an integer of 2 or more) each extending in a horizontal direction of a two-dimensional screen and source lines S1 to Sn (n is an integer of 2 or more) each extending in a vertical direction of the two-dimensional screen are arranged to be intersected. At intersecting portions of the gate lines and the source lines, for example, display cells PC that are liquid crystal elements or organic EL elements are formed.

The drive control unit 11 receives a video signal VS, generates a scanning signal in response to a horizontal synchronization signal included in the video signal VS, and supplies the scanning signal to the gate driver 12. The drive control unit 11 generates a video data signal VPD including the horizontal synchronization signal and a vertical synchronization signal included in the video signal VS, various kinds of control signals including a data load signal indicating a data retrieval timing and a clock signal, and a series of display data pieces PD indicating luminance levels of respective pixels in, for example, 8 bits. The drive control unit 11 supplies the video data signal VPD to the source driver 13.

The drive control unit 11 receives a disconnection information signal BK sent from the source driver 13, and when the disconnection information signal BK indicates a wiring on which a disconnection has occurred (also referred to as a disconnected wiring), the drive control unit 11 includes a series of display data pieces indicating, for example, a warning message of "disconnected" and the disconnected wiring by character information or the like in the series of display data pieces based on the video signal VS.

The gate driver 12 generates a scanning pulse based on a scanning signal supplied from the drive control unit 11, and sequentially and alternatively applies the scanning pulse to the gate lines G1 to Gn of the display panel 20.

The source driver 13 individually detects whether each of the wirings L1 to Ln connecting between the display panel 20 and the source driver 13 is disconnected or not, and when a disconnected wiring is present, the source driver 13 supplies a signal indicating the wiring to the drive control unit 11 as the disconnection information signal BK.

The source driver 13 retrieves a video data signal VPD, and generates n output voltages GV1 to GVn based on the video data signal VPD for each horizontal scanning period. The source driver 13 supplies the output voltages GV1 to GVn to the source lines S1 to Sn of the display panel 20 via the wirings L1 to Ln connecting between the source driver 13 and the source lines S1 to Sn of the display panel 20, respectively. Accordingly, the display panel 20 displays an image based on the video data signal VPD or an image in which the character information or the like indicating the warning message of "disconnected" and the disconnected wiring as described above is superimposed on the image.

Figure 2:
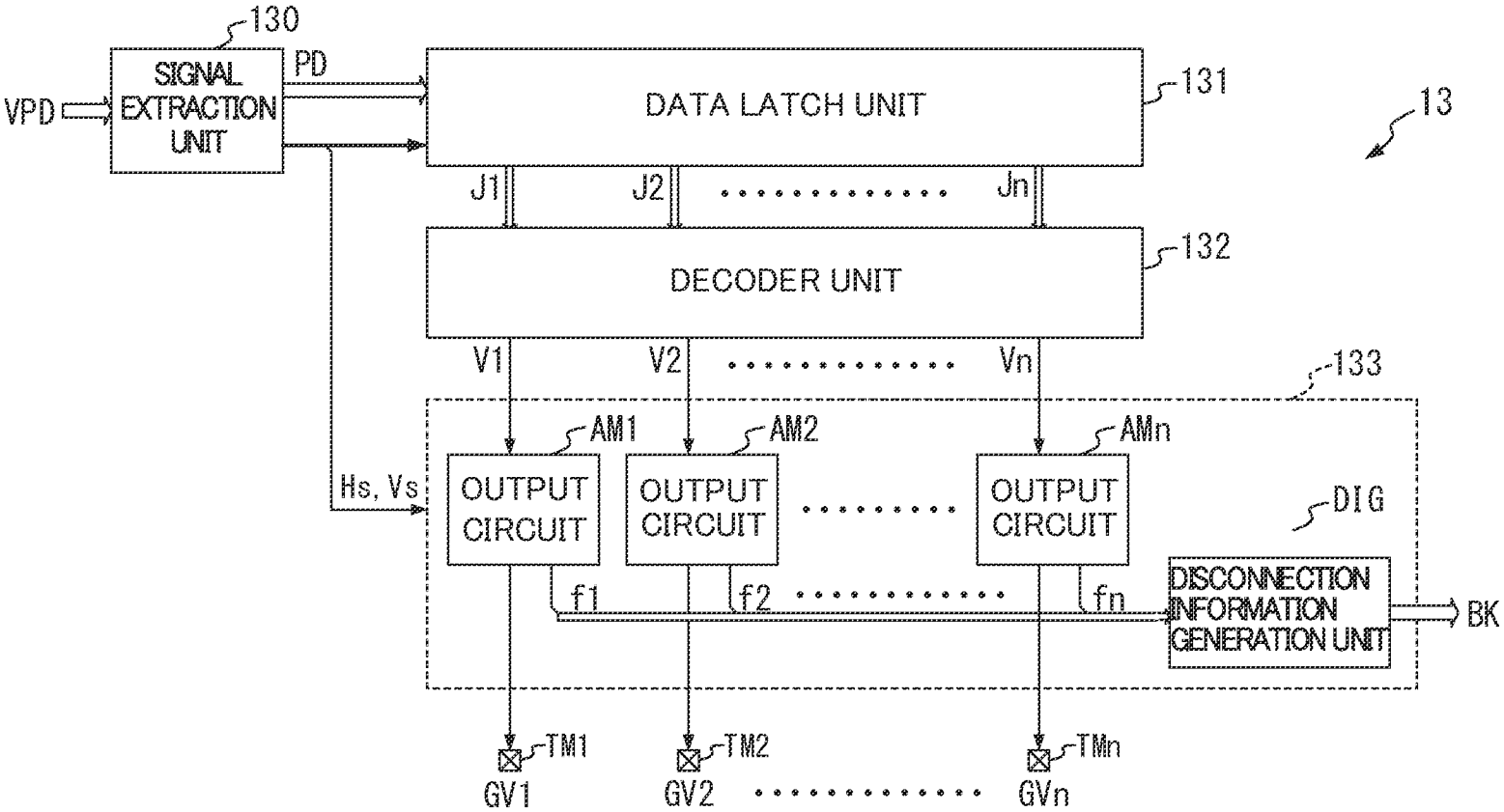
FIG. 2 is a block diagram illustrating an exemplary internal configuration of a source driver 13.

FIG. 2 is a block diagram illustrating an exemplary internal configuration of the source driver 13.

As illustrated in FIG. 2, the source driver 13 includes a signal extraction unit 130, a data latch unit 131, a decoder unit 132, and an output unit 133.

The signal extraction unit 130 extracts the series of display data pieces PD and the above-described various kinds of control signals from the video data signal VPD, and supplies each of them to the data latch unit 131. The signal extraction unit 130 supplies the horizontal synchronization signal included in the video data signal VPD to the output unit 133 as a horizontal synchronization signal Hs. Further, the signal extraction unit 130 generates a binary signal indicating a vertical blanking period by a logic level 1 and a display operation period by a logic level 0 as a vertical blank signal Vblk based on the vertical synchronization signal included in the video data signal VPD, and supplies the vertical blank signal Vblk to the output unit 133.

The data latch unit 131 retrieves the series of display data pieces PD at a timing of the data load signal. The data latch unit 131 supplies each of the display data pieces to the decoder unit 132 as display data J1 to Jn every time when the n display data pieces of one horizontal scanning period are retrieved.

The decoder unit 132 selects a gradation voltage corresponding to a luminance level indicated by display data Jq (q is an integer of from 1 to n) among, for example, 256 gradation voltages having mutually different voltage values for each of the display data J1 to Jn. The decoder unit 132 supplies the n gradation voltages selected based on the display data J1 to Jn as described above to the output unit 133 as gradation voltages V1 to Vn.

The output unit 133 includes output circuits AM1 to AMn disposed corresponding to the source lines S1 to Sn of the display panel 20, respectively, and a disconnection information generation unit DIG.

The output circuits AM1 to AMn receive the gradation voltages V1 to Vn, respectively, and generates output voltages GV1 to GVn having voltage values corresponding to the gradation voltages by individually amplifying the gradation voltages V1 to Vn. The output circuits AM1 to AMn outputs the generated output voltages GV1 to GVn from external terminals TM1 to TMn to the display panel 20. The source lines S1 to Sn of the display panel 20 are connected to the external terminals TM1 to TMn, respectively. The output voltages GV1 to GVn output from the external terminals TM1 to TMn of the source driver 13 are supplied to the source line S1 to Sn of the display panel 20 via the wirings L1 to Ln, respectively.

The output circuits AM1 to AMn detect whether the wirings L1 to Ln are disconnected or not, respectively, and supplies disconnection detection signals f1 to fn indicating detection results of the respective wirings to the disconnection information generation unit DIG. When a disconnection detection signal indicating the occurrence of disconnection is present in the disconnection detection signals f1 to fn, the disconnection information generation unit DIG supplies information indicating the wiring on which the disconnection has occurred (disconnected wiring) to the drive control unit 11 as a disconnection information signal BK.

The output circuits AM1 to AMn have the same internal constitution.

The following describes the internal configuration of the output circuit AM1 extracting the output circuit AM1 from the output circuits AM1 to AMn.

Figure 3:
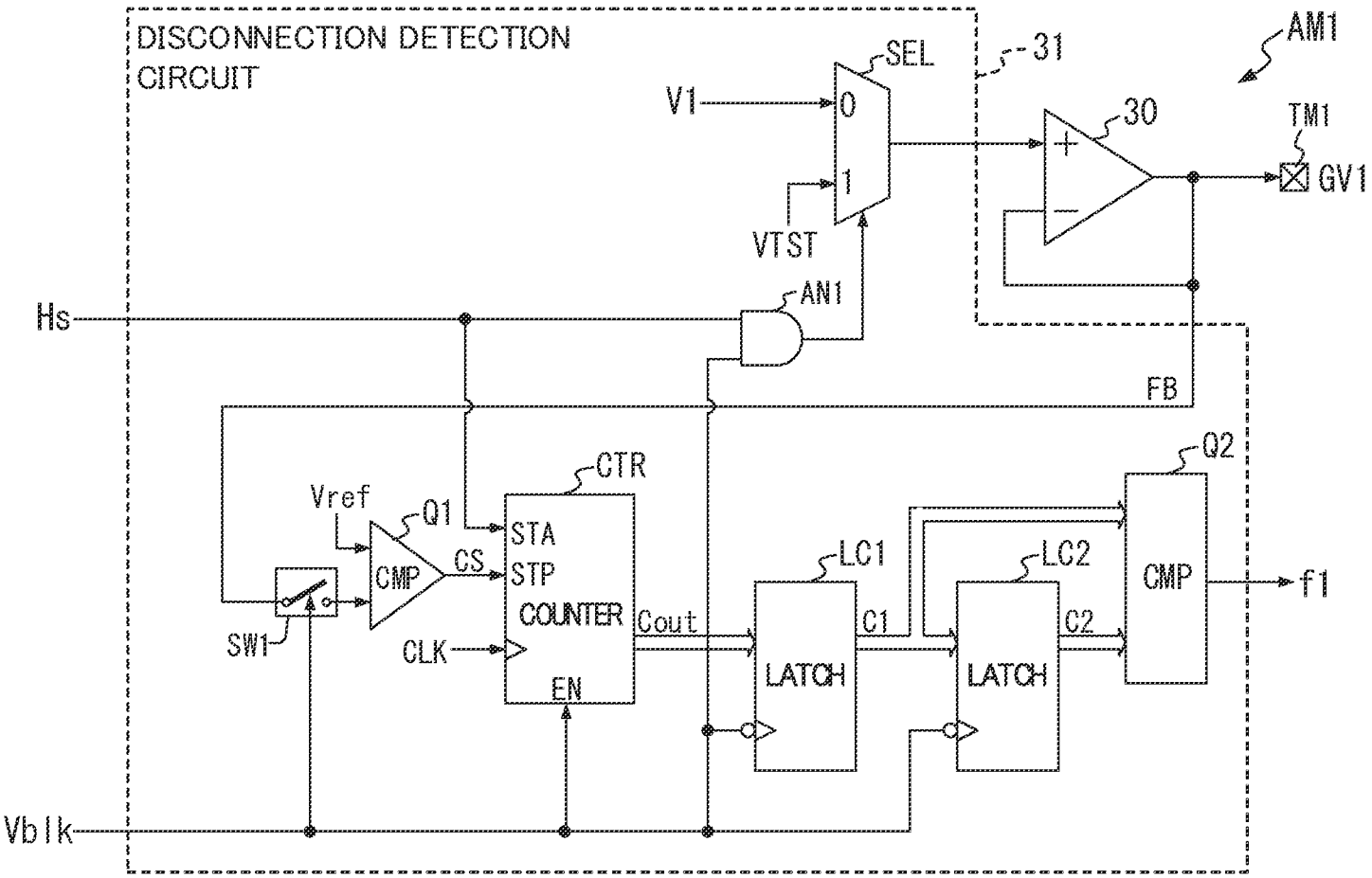
FIG. 3 is a circuit diagram illustrating an exemplary internal configuration of an output circuit AM1.

FIG. 3 is a circuit diagram illustrating an exemplary internal configuration of the output circuit AM1.

The output circuit AM1 includes a disconnection detection circuit 31 in addition to an operational amplifier 30 that generates the output voltage GV1 by amplifying the gradation voltage V1.

The operational amplifier 30 includes an output terminal connected to the external terminal TM1. The operational amplifier 30 receives the gradation voltage V1 by its own non-inverting input terminal, and outputs a current to the external terminal TM1 until the voltage at the external terminal TM1 becomes the same as the voltage received at the non-inverting input terminal.

The disconnection detection circuit 31 includes an AND gate AN1, a selector SEL, a switch SW1, comparators Q1 and Q2, a counter CTR, and latches LC1 and LC2.

The AND gate AN1 supplies the selector SEL with a selection signal of a logic level 1 during a period in which the horizontal synchronization signal Hs and the vertical blank signal Vblk both have the logic level 1 and a selection signal of a logic level 0 during a period in which any one or both of the horizontal synchronization signal Hs and the vertical blank signal Vblk have the logic level 0. That is, the AND gate AN1 supplies the selection signal of the logic level 1 to the selector SEL only at a horizontal synchronization timing in the vertical blanking period, and supplies the selection signal of the logic level 0 to the selector SEL in the other period.

The selector SEL receives the gradation voltage V1 and the test voltage VTST having a predetermined voltage value, and selects one of the gradation voltage V1 and the test voltage VTST based on the above-described selection signal. That is, the selector SEL selects the test voltage VTST at a horizontal synchronization timing in the vertical blanking period, and selects the gradation voltage V1 in the other period. The selector SEL supplies the selected one of the gradation voltage V1 and the test voltage VTST to the non-inverting input terminal of the operational amplifier 30.

The switch SW1 turns ON only during a period in which the vertical blank signal Vblk has the logic level 1, that is, the vertical blanking period, and supplies a voltage of the external terminal TM1 to the comparator Q1 as a disconnection monitoring voltage FB.

The comparator Q1 compares a predetermined reference voltage Vref with the disconnection monitoring voltage FB in magnitude, and supplies a count stop signal CS of the logic level 1 encouraging the stop of counting to the counter CTR when the disconnection monitoring voltage FB is higher than the reference voltage Vref.

The counter CTR turns to an enable state only during the vertical blanking period in which the vertical blank signal Vblk has the logic level 1, and performs an operation below. That is, the counter CTR starts a count operation of the number of pulses of a clock signal CLK from a count value at zero in response to the horizontal synchronization signal Hs, and increments the count value by 1 for each pulse of the clock signal CLK. When the count stop signal CS of the logic level 1 is supplied from the comparator Q1, the counter CTR stops the count operation, and supplies a count signal Cout indicating the count value after the stop of the count to the latch LC1.

That is, the counter CTR acquires the count value after the stop of the count as information indicating a time period (rise time) taken from the supply of the test voltage VTST to the non-inverting input terminal of the operational amplifier 30 until the voltage (FB) of the external terminal TM1 exceeds the reference voltage Vref. The counter CTR turns to a disabled state and stops the count operation during a time period in which the vertical blank signal Vblk has the logic level 0, that is, during an ordinary display operation period.

The latch LC1 retrieves the count signal Cout at a time point at which the vertical blank signal Vblk transitions from the logic level 1 to the logic level 0, that is, at a time point of the transition from the vertical blanking period to the display operation period. The latch LC1 supplies a signal indicating the count value indicated by the retrieved count signal Cout to the latch LC2 and the comparator Q2 as a first frame count signal C1.

The latch LC2 retrieves the first frame count signal C1 at the time point at which the vertical blank signal Vblk transitions from the logic level 1 to the logic level 0. The latch LC2 supplies a signal indicating the count value indicated by the retrieved first frame count signal C1 to the comparator Q2 as a second frame count signal C2.

The comparator Q2 determines whether the count value indicated by the first frame count signal C1 matches the count value indicated by the second frame count signal C2 or not. When both are matched, the comparator Q2 determines that the wiring L1 has not been disconnected, and outputs, for example, the disconnection detection signal f1 of the logic level 0 indicating that the disconnection has not occurred. Meanwhile, when the count value indicated by the first frame count signal C1 does not match the count value indicated by the second frame count signal C2, the comparator Q2 determines that the wiring L1 is disconnected, and outputs the disconnection detection signal f1 of the logic level 1 indicating that the disconnection has occurred.

As described above, each of the output circuits AM2 to AMn other than the output circuit AM1 includes the disconnection detection circuit 31 (AN1, SEL, SW1, Q1, Q2, CTR, LC1, and LC2) illustrated in FIG. 3 together with the operational amplifier 30, and the output circuits AM2 to AMn output the disconnection detection signals f2 to fn individually indicating whether the wirings L2 to Ln are disconnected or not, respectively.

The following describes a disconnection detection operation of the disconnection detection circuit 31 for detecting whether the wiring L1 connecting between the external terminal TM1 of the source driver 13 and the source line S1 of the display panel 20 is disconnected or not for the output circuit AM1 illustrated in FIG. 3 as an example.

The disconnection detection circuit 31 uses the vertical blanking period as a non-display period in each frame of a video signal to detect whether the disconnection has occurred or not in each vertical blanking period. Therefore, with extracted two consecutive frames (first and second frames), the disconnection detection operation of the disconnection detection circuit 31 will be described in a case where the disconnection has not occurred over the first and the second frames, and a case where the disconnection has occurred immediately before the second frame.

[Case of Not Being Disconnected]

Figure 4:
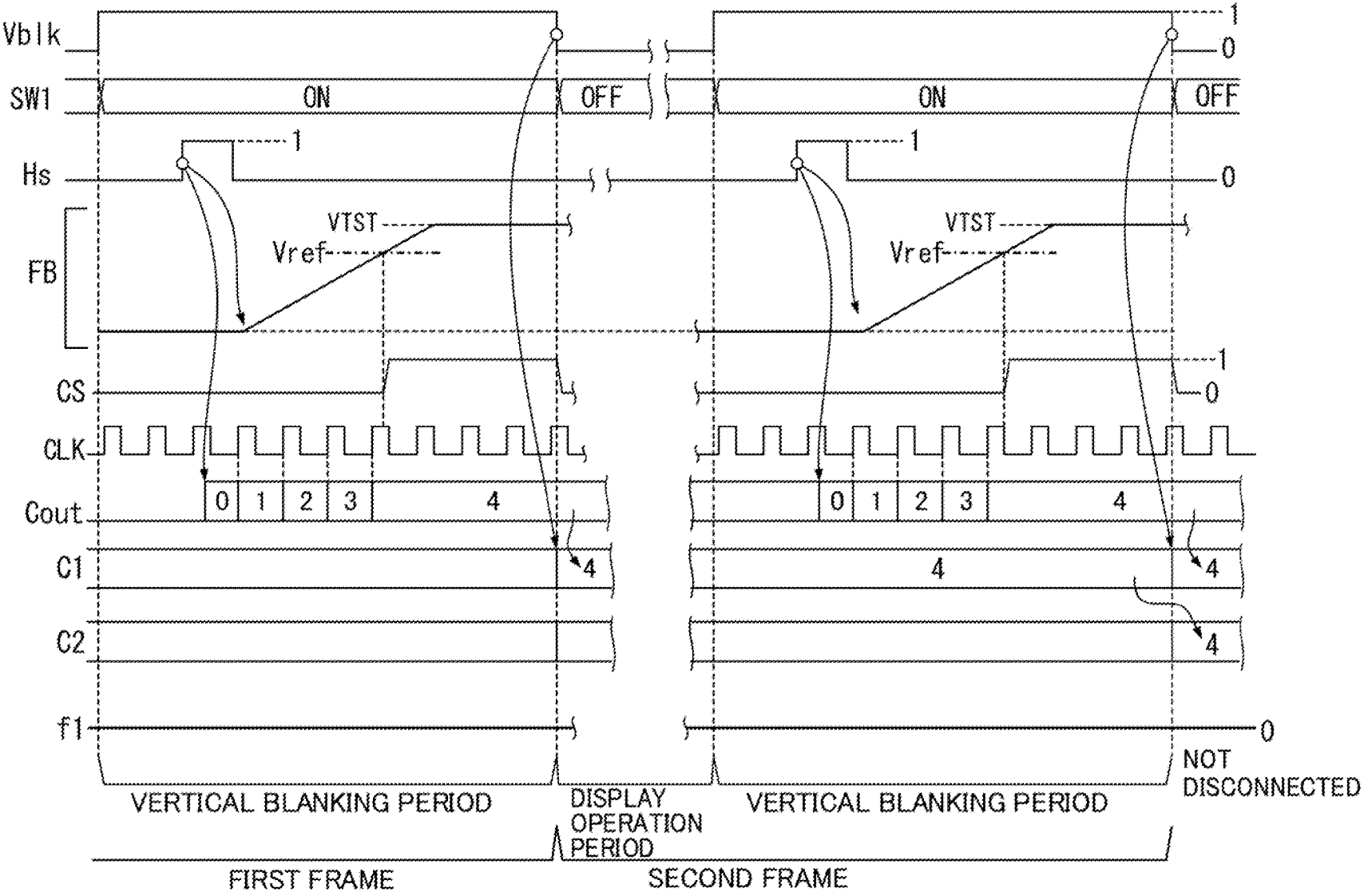
FIG. 4 is a timing chart illustrating an exemplary operation waveform of a disconnection detection circuit 31 when a disconnection has not occurred.

FIG. 4 is a timing chart illustrating an exemplary operation waveform of the disconnection detection circuit 31 of the output circuit AM1 when the wiring L1 has not been disconnected.

As illustrated in FIG. 4, during the vertical blanking period in which the vertical blank signal Vblk keeps the logic level 1, the switch SW1 is ON, and the voltage of the external terminal TM1 is supplied to the comparator Q1 as the disconnection monitoring voltage FB.

In response to the pulse-shaped (logic level 1) horizontal synchronization signal Hs supplied at first in the vertical blanking period of the first frame, the selector SEL supplies the test voltage VTST instead of the gradation voltage V1 to the operational amplifier 30.

The operational amplifier 30 outputs a current to the external terminal TM1 until its own output voltage, that is, the voltage of the external terminal TM1 becomes the same as the test voltage VTST. At this time, since the wiring L1 has not been disconnected, the voltage value of the disconnection monitoring voltage FB gradually increases at a speed based on a wiring capacity of the wiring L1 and the source line S1 connected to the wiring L1.

In response to the first pulse-shaped (logic level 1) horizontal synchronization signal Hs in the vertical blanking period of the first frame, as illustrated in FIG. 4, the counter CTR starts the count of the number of pulses of the clock signal CLK from zero.

Here, since the wiring L1 has not been disconnected, for example, as illustrated in FIG. 4, immediately after the count value (Cout) of the counter CTR reaches "4," the voltage value of the disconnection monitoring voltage FB exceeds the reference voltage Vref. Therefore, at the time point at which the voltage value of the disconnection monitoring voltage FB exceeds the reference voltage Vref, the comparator Q1 supplies the count stop signal CS of the logic level 1 encouraging the stop of the count operation to the counter CTR, thereby stopping the count operation of the counter CTR. Accordingly, the counter CTR supplies the count signal Cout indicating the count value "4" to the latch LC1 as the information indicating the rise time taken from the supply of the test voltage VTST to the non-inverting input terminal of the operational amplifier 30 until the disconnection monitoring voltage FB at the external terminal TM1 exceeds the reference voltage Vref.

The latch LC1 retrieves the count signal Cout indicating the count value "4" at a timing of a falling edge of the vertical blank signal Vblk, and supplies it to the latch LC2 and the comparator Q2 as the first frame count signal C1.

When the wiring L1 is not disconnected before the start of the vertical blanking period of the second frame, the disconnection detection circuit 31 performs an operation similar to the above-described operation also in the vertical blanking period of the next second frame.

That is, the test voltage VTST is supplied to the operational amplifier 30 instead of the gradation voltage V1, and as illustrated in FIG. 4, the voltage value of the disconnection monitoring voltage FB increases at a speed similar to that in the case of the vertical blanking period of the first frame. Then, immediately after the count value (Cout) of the counter CTR reaches "4," the voltage value of the disconnection monitoring voltage FB exceeds the reference voltage Vref. The counter CTR supplies the count signal Cout indicating the count value "4" to the latch LC1 as the information indicating the rise time taken from the supply of the test voltage VTST to the non-inverting input terminal of the operational amplifier 30 until the disconnection monitoring voltage FB at the external terminal TM1 exceeds the reference voltage Vref. Accordingly, the latch LC1 retrieves the count signal Cout indicating the count value "4" at a timing of a falling edge of the vertical blank signal Vblk, and supplies it to the comparator Q2 as the first frame count signal C1.

The latch LC2 retrieves the first frame count signal C1 indicating the count value "4" retrieved by the latch LC1 during the vertical blanking period of the first frame at the timing of the falling edge of the vertical blank signal Vblk, and supplies it to the comparator Q2 as the second frame count signal C2.

Since the count value "4" indicated by the first frame count signal C1 matches the count value "4" indicated by the second frame count signal C2, the comparator Q2 determines that the wiring L1 has not been disconnected, and outputs the disconnection detection signal f1 of the logic level 0 indicating that the disconnection has not occurred.

[Case of Being Disconnected]

Figure 5:
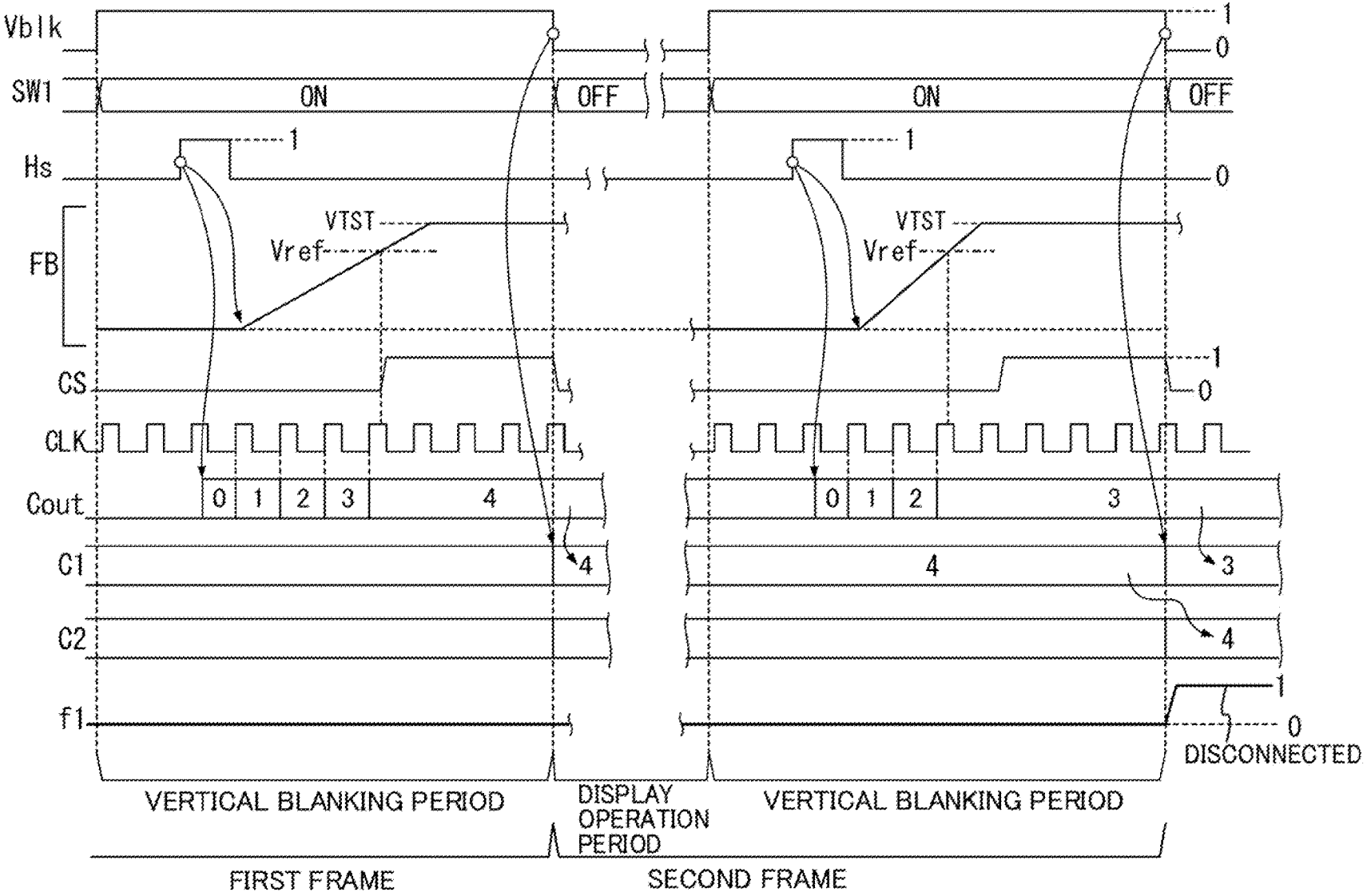
FIG. 5 is a timing chart illustrating an exemplary operation waveform of the disconnection detection circuit 31 when a disconnection has occurred.

FIG. 5 is a timing chart illustrating an exemplary operation waveform of the disconnection detection circuit 31 when the wiring L1 is not disconnected in the vertical blanking period of the first frame but the wiring L1 is disconnected immediately before the vertical blanking period of the next second frame.

Since the operation during the vertical blanking period of the first frame illustrated in FIG. 5 is the same as that of FIG. 4, the explanation of the operation will be omitted.

In the vertical blanking period of the second frame illustrated in FIG. 5, by supplying the test voltage VTST to the non-inverting input terminal of the operational amplifier 30, the voltage value of the disconnection monitoring voltage FB increases as illustrated in FIG. 5.

However, since the wiring L1 is disconnected and the connection with the source line S1 is cutoff, the wiring capacity at the external terminal TM1 is significantly decreased compared with the case where the disconnection has not occurred. Therefore, the voltage value of the disconnection monitoring voltage FB increases at a high speed by the amount, and for example, as illustrated in FIG. 5, at a time point of the count value (Cout) "3" of the counter CTR, the voltage value of the disconnection monitoring voltage FB exceeds the reference voltage Vref. Accordingly, the counter CTR stops the count operation, and supplies the count value "3" after the stop of the count operation to the latch LC1 as the count signal Cout indicating the rise time described above. Thus, the latch LC1 retrieves the count signal Cout indicating the count value "3" at a timing of a falling edge of the vertical blank signal Vblk, and supplies it to the comparator Q2 as the first frame count signal C1.

The latch LC2 retrieves the first frame count signal C1 indicating the count value "4" retrieved by the latch LC1 during the vertical blanking period of the first frame as the rise time at the timing of the falling edge of the vertical blank signal Vblk, and supplies it to the comparator Q2 as the second frame count signal C2.

At this time, since the count value "3" indicated by the first frame count signal C1 does not match the count value "4" indicated by the second frame count signal C2, the comparator Q2 determines that the wiring L1 is disconnected, and outputs the disconnection detection signal f1 of the logic level 1 indicating the occurrence of the disconnection.

As described in detail above, the source driver 13 detects the disconnection of the respective wirings L1 to Ln individually connecting between the external terminals TM1 to TMn and the source lines S1 to Sn by the disconnection detection circuits 31 disposed in the output circuits AM1 to AMn, respectively.

That is, the disconnection detection circuit 31 supplies the test voltage VTST instead of the gradation voltage Vt (t is an integer of from 1 to n) to the non-inverting input terminal of the operational amplifier 30 in each of the vertical blanking periods. Further, the disconnection detection circuit 31 counts the number of pulses of the clock signal CLK from the time point of supplying the test voltage VTST until the disconnection monitoring voltage FB at the external terminal TMt exceeds the reference voltage Vref, thereby measuring the rise time of the disconnection monitoring voltage FB.

Next, the disconnection detection circuit 31 determines whether the rise time (C1) measured in the vertical blanking period of the first frame in the two consecutive frames matches the rise time (C2) measured in the vertical blanking period of the second frame or not (Q2). Here, when both rise times (C1, C2) are matched, the disconnection detection circuit 31 determines that the wiring Lt (t is an integer of from 1 to n) has not been disconnected, and outputs, for example, the disconnection detection signal ft of the logic level 0 indicating the fact. Meanwhile, when both rise times (C1, C2) are not matched, the disconnection detection circuit 31 determines that the wiring Lt is disconnected, and outputs the disconnection detection signal ft of the logic level 1 indicating the fact.

Thus, by focusing on the change rate of the voltage at the external terminal TMt that increases in the case where the wiring Lt is disconnected compared with the case where the disconnection has not occurred, the disconnection detection circuit 31 determines the occurrence of the disconnection when the rise times (C1, C2) of the voltage at the external terminal TMt are not matched between the two frames.

Accordingly, during the ordinary use of the display device 100, whether the disconnection of the wirings L1 to Ln connecting between the external terminals TM1 to TMn of the source driver 13 and the source lines S1 to Sn of the display panel 20 has occurred or not can be determined in the source driver 13 side.

While the disconnection detection process is performed in the vertical blanking periods as the non-display periods of the respective frames in the above-described embodiment, the disconnection detection process as described above may be performed in a non-display period other than the vertical blanking period.

While the count value of the number of pulses of the clock signal counted by the counter CTR is used as the rise time taken from the supply of the test voltage VTST to the operational amplifier 30 until the voltage (FB) at the external terminal exceeds the reference voltage Vref, the rise time itself may be measured without using the counter.

In the above-described embodiment, the occurrence of the disconnection is determined when the rise times (C1, C2) of the voltage at the external terminal TMt measured in the respective two frames are not matched. However, when a frequency higher than that of the clock signal CLK illustrated in FIG. 3 is employed as a frequency of the clock signal CLK, a slight measurement error is generated between the rise times (C1, C2) measured in the respective two frames in some cases even when the disconnection has not occurred.

Therefore, the comparator Q2 may be configured to determine the occurrence of the disconnection when a difference between the rise time (C1) measured in the first frame and the rise time (C2) measured in the second frame is equal to or more than a predetermined value (equivalent to the amount of the measurement error).

While the disconnection is detected by mutually comparing the rise times measured in the respective consecutive first frame and second frame in the above-described embodiment, the two frames in which the rise times are measured need not be necessarily consecutive frames.

In the above-described embodiment, the test voltage VTST is supplied to the non-inverting input terminal of the operational amplifier 30, and the count operation of the counter CTR is started at the timing of the horizontal synchronization signal Hs. However, the test voltage VTST may be supplied to the non-inverting input terminal of the operational amplifier 30 and the count operation of the counter CTR may be started in response to a timing signal of one pulse generated in the vertical blanking period based on the vertical synchronization signal.

Basically, the display driver according to the present invention includes a plurality of external terminals (TM1 to TMn) and a plurality of output circuits (AM1 to AMn). The plurality of output circuits are disposed corresponding to the respective external terminals and each connected to the corresponding one external terminal. The plurality of output circuits output the output voltages (GV1 to GVn) obtained by amplifying the gradation voltages (V1 to Vn) based on the video signal from the external terminals (TM1 to TMn), thereby supplying the output voltage group to the source lines (S1 to Sn) of the display panel (20) via the wirings (L1 to Ln).

Each of the plurality of output circuits (AM1 to AMn) only needs to include an operational amplifier below and a disconnection detection circuit that detects whether a wiring connected to the one external terminal is disconnected or not.

That is, the operational amplifier (30) receives the gradation voltage by the input terminal, and outputs a current to the one external terminal until the voltage of the one external terminal becomes the same as the voltage received by the input terminal.

The test voltage supply unit (AN1, SEL) supplies the test voltage (VTST) instead of the gradation voltage to the input terminal of the operational amplifier in the non-display period (for example, vertical blanking period) of each frame of the video signal. The measurement unit (Q1, CTR) measures a time period taken from the supply of the test voltage to the input terminal of the operational amplifier until the voltage (FB) of the one external terminal exceeds the reference voltage (Vref) as the rise time (Cout). The disconnection determination unit (LC1, LC2, Q2) outputs the disconnection detection signal (f1) indicating whether the wiring connected to the one external terminal is disconnected or not based on the rise time (C1) measured in one frame and the rise time (C2) measured in the other frame of the respective frames.

What is claimed is:

1. A display driver comprising:

a plurality of external terminals; and a plurality of output circuits disposed corresponding to the respective plurality of external terminals, each of the plurality of output circuits being connected to one corresponding external terminal among the plurality of external terminals, the plurality of output circuits supplying a plurality of output voltages to a plurality of source lines of a display panel via a plurality of wirings connected to the plurality of external terminals by outputting the plurality of output voltages from the plurality of external terminals, the plurality of output voltages being obtained by amplifying a plurality of gradation voltages based on a video signal, wherein each of the plurality of output circuits includes:

an operational amplifier that receives the gradation voltage by an input terminal thereof, and outputs a current to the one external terminal until a voltage of the external terminal becomes equal to the voltage received by the input terminal; and a disconnection detection circuit that detects whether the wiring connected to the one external terminal is disconnected or not, and the disconnection detection circuit includes:

a test voltage supply unit that supplies a test voltage instead of the gradation voltage to the input terminal of the operational amplifier in a non-display period of each frame of the video signal;

a measurement unit that measures a time period taken from the supply of the test voltage to the input terminal of the operational amplifier until the voltage of the one external terminal exceeds a reference voltage as a rise time; and a disconnection determination unit that outputs a disconnection detection signal indicating whether the wiring connected to the one external terminal is disconnected or not based on the rise time measured in one frame and the rise time measured in another frame of the respective frames.

2. The display driver according to claim 1, wherein the disconnection determination unit determines that the wiring connected to the one external terminal is disconnected and outputs the disconnection detection signal indicating the disconnection when the rise time measured in the one frame does not match the rise time measured in the other frame.

3. The display driver according to claim 1, wherein the disconnection determination unit determines that the wiring connected to the one external terminal is disconnected and outputs the disconnection detection signal indicating the disconnection when a difference between the rise time measured in the one frame and the rise time measured in the other frame is equal to or more than a predetermined value.

4. The display driver according to claim 1, wherein the measurement unit includes:

a counter that starts a count operation to obtain a count value by counting a count of pulses of a clock signal at a timing of the supply of the test voltage to the input terminal of the operational amplifier; and a first comparator that compares the voltage of the external terminal with the reference voltage in magnitude, and supplies a count stop signal to stop the count operation to the counter when the voltage of the external terminal becomes higher than the reference voltage, and the measurement unit outputs a count value of the counter after stopping the count operation as the rise time.

5. The display driver according to claim 4, wherein the one frame and the other frame are frames consecutive to one another, and the disconnection determination unit includes:

a first latch that retrieves the count value of the counter after stopping the count operation at a timing of an end of the non-display period, and outputs the retrieved count value as a first frame count signal;

a second latch that retrieves the first frame count signal at the timing of the end of the non-display period, and outputs the retrieved first frame count signal as a second frame count signal; and a second comparator that performs a comparison to determine whether the first frame count signal matches the second frame count signal or not, and outputs the disconnection detection signal indicating the disconnection in a case of not being matched.

6. The display driver according to claim 1, wherein the non-display period is a vertical blanking period.

7. The display driver according to claim 5, comprising a signal extraction unit that extracts a horizontal synchronization signal and a vertical synchronization signal from the video signal, and generates a vertical blank signal indicating the vertical blanking period or not in binary in response to the vertical synchronization signal, wherein the test voltage supply unit supplies the test voltage to the input terminal of the operational amplifier at a timing of the extracted horizontal synchronization signal during the vertical blanking period indicated by the vertical blank signal, the counter turns to an enable state only during the vertical blanking period indicated by the vertical blank signal, and starts the count operation at the timing of the horizontal synchronization signal, and the first latch and the second latch retrieve the first frame count signal and the second frame count signal at a timing of an edge of the vertical blank signal, respectively.

8. A display device comprising:

a display driver that includes a plurality of external terminals and a plurality of output circuits disposed corresponding to the respective plurality of external terminals, each of the plurality of output circuits being connected to one corresponding external terminal among the plurality of external terminals, the plurality of output circuits outputting a plurality of output voltages obtained by amplifying a plurality of gradation voltages based on a video signal from the plurality of external terminals;

a display panel including a plurality of source lines; and a plurality of wirings connecting between the plurality of external terminals and the plurality of source lines, wherein each of the plurality of output circuits includes:

an operational amplifier that receives the gradation voltage by an input terminal thereof, and outputs a current to the one external terminal until a voltage of the external terminal becomes equal to the voltage received by the input terminal; and a disconnection detection circuit that detects whether the wiring connected to the one external terminal is disconnected or not, and the disconnection detection circuit includes:

a test voltage supply unit that supplies a test voltage instead of the gradation voltage to the input terminal of the operational amplifier in a non-display period of each frame of the video signal;

a measurement unit that measures a time period taken from the supply of the test voltage to the input terminal of the operational amplifier until the voltage of the one external terminal exceeds a reference voltage as a rise time; and a disconnection determination unit that determines a disconnection of the wiring connected to the one external terminal and outputs a disconnection detection signal indicating the disconnection when the rise time measured in one frame does not match the rise time measured in another frame of the respective frames.

* * * * *